US011566479B1

(12) United States Patent
Ogundare et al.

(10) Patent No.: US 11,566,479 B1
(45) Date of Patent: Jan. 31, 2023

(54) GRIPPER CONTROL IN A COILED TUBING SYSTEM

(71) Applicant: Halliburton Energy Services, Inc., Houston, TX (US)

(72) Inventors: Oluwatosin Ogundare, Houston, TX (US); Radovan Rolovic, Houston, TX (US); Roshan Joy Jacob, Houston, TX (US); Ramalakshmi Somaskandan, Houston, TX (US); Jeremy C. Nicholson, Houston, TX (US); Glenn Marvin Ozburn, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/517,959

(22) Filed: Nov. 3, 2021

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS

| | | | | |
|---|---|---|---|---|
| 6,892,810 | B2 | 5/2005 | Austbo et al. | |
| 10,024,123 | B2 * | 7/2018 | Steffenhagen | E21B 44/02 |
| 10,323,471 | B2 * | 6/2019 | Dobkins | G05B 19/056 |
| 2016/0017675 | A1 | 1/2016 | Armstrong et al. | |
| 2016/0186509 | A1 | 6/2016 | Steffenhagen et al. | |
| 2017/0260817 | A1 | 9/2017 | Dobkins et al. | |

FOREIGN PATENT DOCUMENTS

| | | |
|---|---|---|
| CN | 110485951 | 3/2020 |
| EP | 0864031 | 4/2004 |
| WO | 2021/015740 A1 | 1/2021 |

OTHER PUBLICATIONS

International Search Report and Written Opinion for Application No. PCT/US2021/058251, dated Jul. 26, 2022.

* cited by examiner

*Primary Examiner* — Matthew R Buck
(74) *Attorney, Agent, or Firm* — Thomas Rooney; C. Tumey Law Group PLLC

(57) ABSTRACT

A system is provided including a coiled tubing injector including at least two gripper chains for gripping a coiled tubing and a gripper system for generating a gripper force applied to the at least two gripper chains by adjusting gripper pressure on at least one gripper cylinder. A gripper controller is configured to determine a minimum gripper pressure and a maximum gripper pressure for the gripper cylinders, based on a current set of parameters related to lowering the coiled tubing into a wellbore or pulling out the coiled tubing from the wellbore. The gripper controller selects a target gripper pressure between the minimum gripper pressure and the maximum gripper pressure based on a historical data model and sets the target gripper pressure for the at least one gripper cylinder.

26 Claims, 5 Drawing Sheets

GRIPPER CONTROL IN A COILED TUBING SYSTEM

TECHNICAL FIELD

The present disclosure relates generally to well drilling and completion operations and, more particularly, to gripper control in coiled tubing systems.

BACKGROUND

Reeled or coiled tubing has been run into wells for many years for performing certain downhole operations, including but not limited to completions, washing, circulating, production, production enhancement, cementing, inspecting and logging. Such tubing is typically inserted into a wellbore by a coiled tubing injector apparatus which generally incorporates a multitude of gripper blocks for handling the tubing as it passes through the injector. The tubing is flexible and can therefore be cyclically coiled onto and off of a spool, or reel, by the injector which often acts in concert with a windlass and a power supply which drives the spool, or reel.

BRIEF DESCRIPTION OF DRAWINGS

Some specific exemplary aspects of the disclosure may be understood by referring, in part, to the following description and the accompanying drawings.

Figure 1:
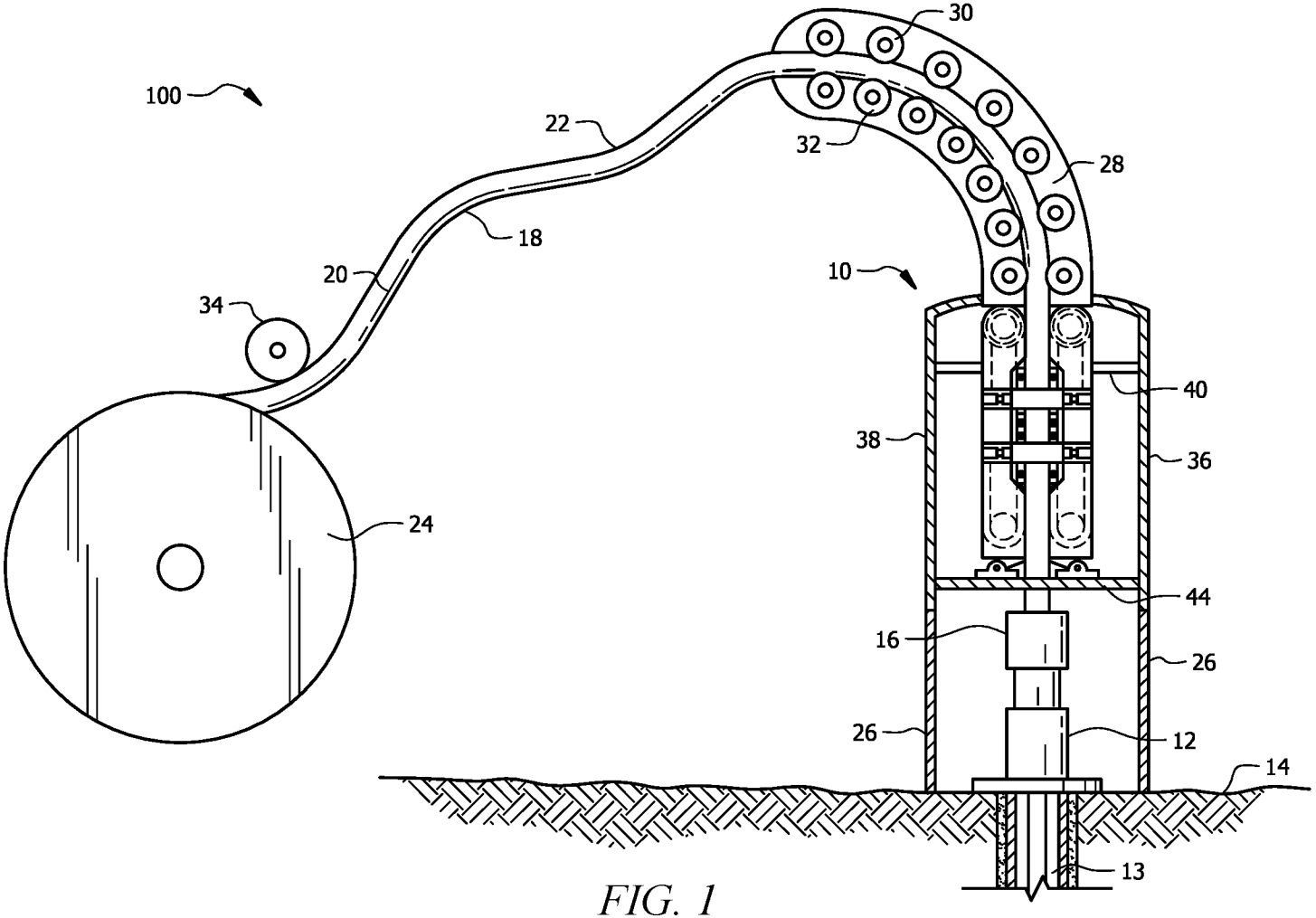
FIG. 1 is a schematic of an example coiled tubing injector system in which aspects of the present disclosure may be practiced.

While aspects of this disclosure have been depicted and described and are defined by reference to exemplary aspects of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described aspects of this disclosure are examples only, and not exhaustive of the scope of the disclosure.

DETAILED DESCRIPTION

Aspects of the present disclosure provide improved techniques for automatically determining an optimized gripper pressure to set for gripper cylinders of an injector to apply a corresponding optimized gripping force on a set of gripper chains that engage a coiled tubing during a coiled tubing injector operation.

The disclosed system and methods provide several practical applications and technical advantages. For example, the disclosed system provides the practical application of automatically determining an optimized target gripper pressure to set of gripper cylinders of an injector during a coiled tubing injector operation. As described in accordance with one or more embodiments of the present disclosure, a gripper controller automatically determines an operating pressure window for the gripper cylinders at any stage during the injector operation, and then determines an optimized target gripper pressure to be applied to the gripper cylinders based on a historical data model. To determine the operating pressure window, the gripper controller determines a minimum gripper pressure that is to be applied to the gripper cylinders to avoid pipe slippage and a maximum allowed gripper pressure that can be applied to the gripper cylinders to avoid pipe damage. The gripper pressure set for the gripper cylinders controls the gripping force applied to the gripper chains of the coiled tubing injector. Thus, the operating window for the gripper pressure defines an operating window for the gripping force. The gripper controller selects a target gripper pressure that lies within the determined pressure window and is optimized based on the historical data model. By determining the gripper pressure window, gripper controller avoids the target gripper pressure from being set too low resulting in pipe slippage or set too high to damage the coiled tubing. The historical data model provides the gripper controller benefit of past experiences under similar conditions and a concrete guide to what target gripping pressures can be optimal for the given conditions. For example, as described above, the historical data model provides gripper pressure values and/or corresponding gripping force values that were determined to be optimal for a given set of conditions (e.g., parameter values). Optimizing the target gripper pressure to be set for the gripper cylinders based on the historical data model helps minimize pipe damage. In one or more embodiments, the gripper controller may be configured to continuously monitor one or more parameters relating to the injector operation and adjust the target gripper pressure as needed when an injector operation is in progress. For example, the gripper controller may be configured to determine and adjust the target gripper periodically, randomly or based on a pre-selected schedule. The entire operation including monitoring the parameters related to the operation of the injector, determining the gripper pressure window, selecting an optimized target gripper pressure and adjusting the target gripper pressure for the gripper cylinders is designed to be fully automatic and not needing operator intervention. Thus, the disclosed system and methods significantly reduce operator burden. Further, by determining optimized gripper pressure values in accordance with techniques disclosed herein, the disclosed system and methods avoid the gripper pressure from being set too low resulting in pipe slippage or too high resulting in pipe damage. Further, the adjustment of the gripper pressure throughout the operation of the injector may ensure minimal damage to the coiled tubing.

The disclosed system and methods provide an additional practical application of using a hoisting load of the injector and an internal pressure of the coiled tubing to determine the maximum gripping force to be applied to the gripper chains. Both the hoisting load and internal pressure of the coiled tubing at any time during an injector operation can affect the maximum gripper pressure or resulting gripping force that can be applied to the injector. Thus, considering the hoisting load and the internal pressure of the coiled tubing when determining the maximum gripping force may yield a more accurate value of the maximum gripping force which may help avoid damage to the coiled tubing.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (for example, a hard disk drive or floppy disk drive), a sequential access storage device (for example, a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative aspects of the present disclosure are described in detail herein. In the interest of clarity, not all features of an actual implementation may be described in this specification. It will of course be appreciated that in the development of any such actual aspect, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

To facilitate a better understanding of the present disclosure, the following examples of certain aspects are given. In no way should the following examples be read to limit, or define, the scope of the invention. Aspects of the present disclosure may be applicable to horizontal, vertical, deviated, or otherwise nonlinear wellbores in any type of subterranean formation. Aspects may be applicable to injection wells as well as production wells, including hydrocarbon wells. Aspects may be implemented using a tool that is made suitable for testing, retrieval and sampling along sections of the formation. Aspects may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with certain aspects may be used in one or more of wireline (including wireline, slickline, and coiled tubing), downhole robot, MWD, and LWD operations.

A coiled tubing injector (also referred to as injector head) utilizes a pair of opposed endless drive chains which are arranged in a common plane. These opposed endless drive chains are often referred to as gripper chains because each chain has a multitude of gripper blocks attached therealong. The gripper chains are driven by respective drive sprockets which are in turn powered by a reversible hydraulic motor. Each gripper chain is also provided with a respective idler sprocket to maintain each gripper chain within the common plane. Both the drive sprockets and idler sprockets are mounted on a common frame wherein the distance between centers of all the sprockets are essentially of a constant distance from each other. That is, the drive sprockets are free to rotate, but are not free to move either vertically or laterally with respect to each other. The idler sprockets are not free to move laterally with respect to each other but are vertically adjustable within a limited range in order to set the amount of play in each gripper chain. Such vertical adjustment is made by either a mechanical adjusting means or a hydraulic adjusting means. Typically, for injectors having mechanical adjustment means, the adjustment is made when the injector is not in operation.

The opposed gripper chains, preferably via the gripper blocks, sequentially grasp the tubing that is positioned between the opposed gripper chains. When the gripper chains are in motion, each gripper chain has a gripper block that is coming into contact with the tubing as another gripper block on the same gripper chain is breaking contact with the tubing. This continues in an endless fashion as the gripper chains are driven to force the tubing into or out of the wellbore, depending on the direction in which the drive sprockets are rotated. Gripper blocks such as those set forth in U.S. Pat. No. 5,094,340, issued Mar. 10, 1992, to Avakov, which is incorporated herein by reference, may be used.

The gripper chain is provided with a predetermined amount of slack which allows the gripper chain to be biased against the tubing to inject the tubing into and out of the wellbore. This biasing is accomplished with an endless roller chain disposed inside each gripper chain. Each roller chain engages sprockets rotatably mounted on a respective linear bearing beam, referred to herein as a linear beam. A linkage and hydraulic cylinder mechanism allows the linear beams to be moved toward one another so that each roller chain is moved against its corresponding gripper chain such that the tubing facing portion of the gripper chain is moved toward the tubing so that the gripper blocks can engage the tubing and move it through the apparatus. The gripper blocks will engage the tubing along a working length of the linear beam.

Each gripper chain has a gripper block that contacts the tubing at the top of the working length as a gripper block on the same chain is breaking contact at a bottom of the working length of the linear beam.

The fixed distance between each set of drive sprockets and idler sprockets requires some significant lateral movement in the gripper chain when engaged by the roller chain on the corresponding linear beam in order to allow the gripper chains to engage the tubing by way of the gripper blocks. The reason for having the requisite amount of lateral play in the gripper chains is to provide a limited amount of clearance between the gripper chains, upon moving the respective roller chains away from the vertical centerline of the injector, to allow the passage of tubing and tools having larger outside diameters or dimensions.

FIG. 1 is a schematic of an example coiled tubing injector system 100 in which aspects of the present disclosure may be practiced.

As shown in FIG. 1, coiled tubing injector 10 (also referred to as injector head) is shown positioned above a wellhead 12 of a well 13 at a ground surface or subsea floor 14. A lubricator or stuffing box 16 is connected to the upper end of wellhead 12.

Coiled tubing 18, having a longitudinal central axis 20 and an outer diameter or outer surface 22, is supplied on a large drum, or reel 24 and is typically several thousand feet in length. Tubing 18 of sufficient length may be inserted into the well 13 either as single tubing, or as tubing spliced by connectors or by welding. The outer diameters of the tubing 18 typically range from approximately one inch (2.5 cm) to approximately five inches (12.5 cm). The disclosed injector 10 is readily adaptable to even larger diameters. Tubing 18 is normally spooled from drum 24 typically supported on a truck (not shown) for mobile operations.

Injector 10 is mounted above wellhead 12 on legs 26. A guide framework 28 having a plurality of pairs of guide rollers 30 and 32 rotatably mounted thereon extends upwardly from injector 10.

Tubing 18 is supplied from drum 24 and is run between rollers 30 and 32. As tubing 18 is unspooled from drum 24, generally it will pass adjacent to a measuring device, such as wheel 34. Alternatively, the measuring device may be incorporated in injector 10.

Rollers 30 and 32 define a pathway for tubing 18 so that the curvature in the tubing 18 is slowly straightened as it enters injector 10. As will be understood, tubing 18 is preferably formed of a material which is sufficiently flexible and ductile that it can be curved for storage on drum 24 and also later straightened. While the material is flexible and ductile, and will accept bending around a radius of curvature, it runs the risk of being pinched or suffer from premature fatigue failure should the curvature be severe. Rollers 30 and 32 are spaced such that straightening of the tubing 18 is accomplished wherein the tubing 18 is inserted into the well 13 without kinks or undue bending on the tubing 18. However, the disclosed injector 10 can be used for injecting, suspending, or extracting any generally elongated body.

Figure 2:
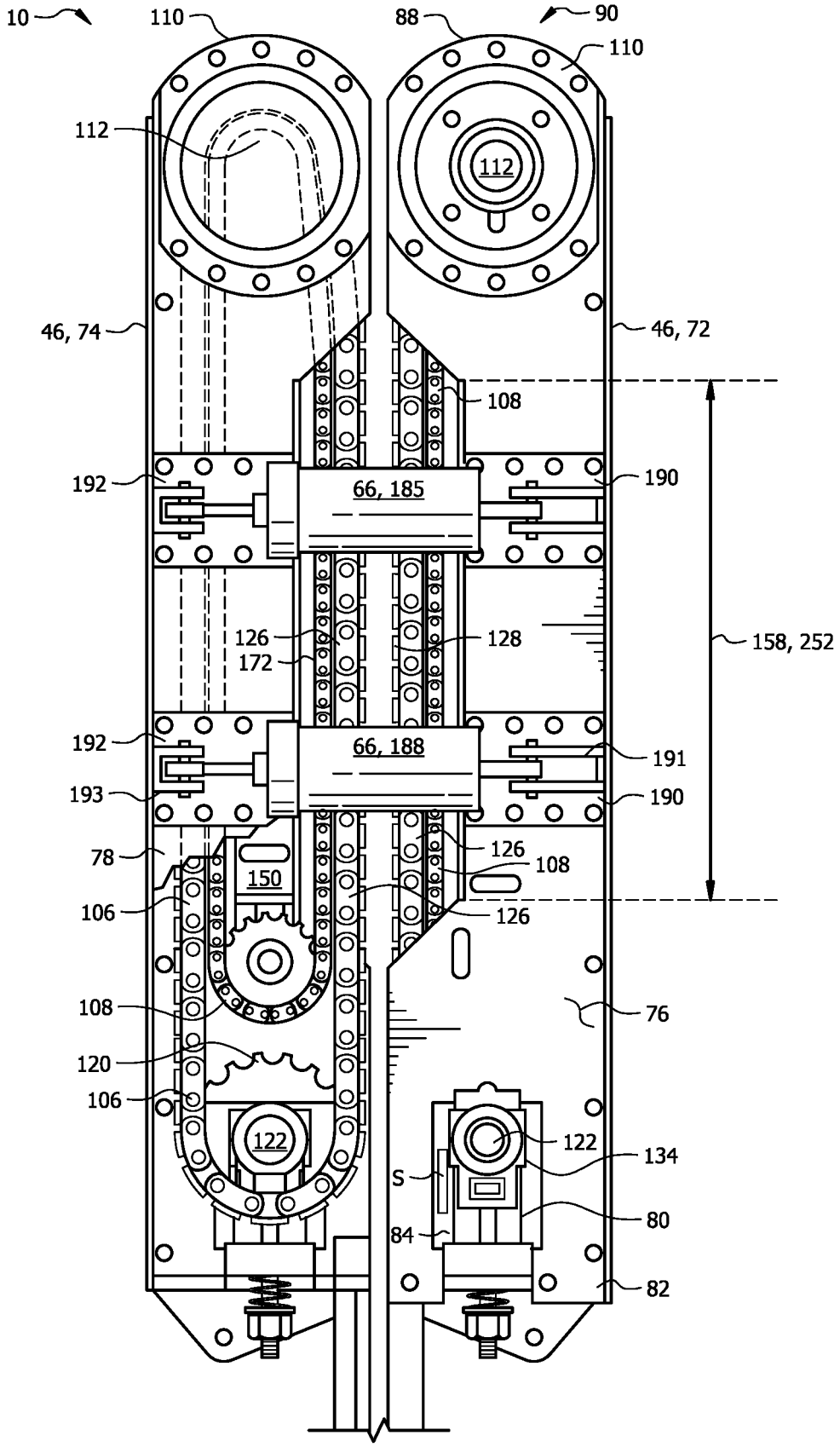
FIG. 2 illustrates details of an example injector of FIG. 1 in which aspects of the present disclosure can be practiced.

FIG. 2 illustrates details of an example injector 10 in which aspects of the present disclosure can be practiced.

Injector 10 includes a frame 36 (shown in FIG. 1). Frame 36 has legs 38, rear supports 40, and side supports (not shown). Injector 10 further comprises a base 44 which makes up a part of frame 36, and a pair of substantially similar carriages 46 (shown in FIG. 2) extending upward therefrom. The injector 10 also includes hydraulic gripper cylinders 66 for moving the carriages 46 laterally with respect to one another and with respect to the base 44. Carriages 46 comprise a first or right side carriage 72 and a second or left side carriage 74. Carriages 72 and 74 can move towards and away from each other when gripper cylinders 66 are actuated. Carriages 72 and 74 are substantially similar in that, as seen in FIG. 2, carriages 72 and 74 are mirror images of one another. Right side carriage 72 comprises first outer plate 76 and the left side carriage 74 comprises a second outer plate 78 (shown as partially cutout). Outer plates 76 and 78 are mirror images of one another. First outer plate 76 may include a rectangular cutout 80 at or near a lower end 82 thereof. A pair of bosses 84 extend along the sides of rectangular cutout 80. First outer plate 76 has a mounting boss 88 at an upper end 90 thereof. Second outer plate 78, being a mirror image of first outer plate 76, likewise includes a rectangular cutout (not shown) at or near a lower end thereof and a pair of bosses (not shown) extending downwardly along sides of rectangular cutout. Second outer plate 78 also has a mounting boss at an upper end thereof.

Each carriage 46 also includes a gripper chain drive system 106 and a roller chain drive system 108. Gripper chain drive system 106 includes a pair of spaced gripper chain drive sprockets 110 rotatably disposed in the carriage 46. Drive sprockets 110 are mounted on respective drive sprocket shafts 112 having a centerline, or longitudinal central axis corresponding to, or collinear with, an axis of rotation of the drive sprockets 110. Each drive sprocket 110 is driven by a reversible hydraulic motor (not shown) attached to each carriage 46 on the back side of the injector 10. The hydraulic motor may be any type known in the art and is driven by a planetary gear and has an integral brake. Thus, the hydraulic motor can inject, retract, or suspend tubing 18 in the well 13. Drive sprocket shafts 112 may be keyed or otherwise connected to drive sprockets 110, so that rotation of drive sprocket shaft 112 will rotate drive sprockets 110.

Gripper chain drive system 106 also includes a pair of spaced gripper chain idler sprockets 120 which are rotatably disposed in the lower end of each carriage 46. Idler sprockets 120 are mounted on idler sprocket shaft 122, having a centerline, or longitudinal central axis corresponding to, or collinear with, an axis of rotation of the idler sprockets 120. In the embodiment shown, the idler sprocket shaft 122 and idler sprockets 120 are one piece. However, idler sprocket shaft 122 may be keyed or otherwise connected to idler sprockets 120 so that idler sprocket shaft 122 and idler sprockets 120 will rotate together. The gripper chain drive system 106 further includes a pair of opposing gripper chains 126 mounted on respective drive sprockets 110 and idler sprockets 120. Each gripper chain 126 is engaged with a drive sprocket 110 and an idler sprockets 120 in each carriage 46. Each gripper chain 126 may be of a kind known in the art and includes a plurality of outwardly facing gripper blocks 128 (or grippers) disposed thereon.

Gripper blocks 128 are adapted for engaging tubing 18 and moving it through injector 10. Gripper blocks 128 may be like those set forth in U.S. Pat. No. 5,853,118, issued Dec. 29, 1998, to Avakov or U.S. Pat. No. 6,230,955, issued May 15, 2001, to Parks, both of which are incorporated herein by reference and assigned to the assignee of the present invention. When gripper cylinders 66 are actuated to move carriages 72 and 74 together, a gripping force is applied to tubing 18 by gripper blocks 128. Griper blocks 128 generally have an inner face defining an inner profile. The gripper blocks 128 contact the outer diameter 22 of tubing 18 on both sides of longitudinal central axis 20.

Tensioners (not shown) may be provided for adjustment of the position of the idler sprocket shafts 122 so that proper tension on gripper chains 126 may be maintained, and so that the proper distance, and parallel relationship between idler sprocket shafts 122 and drive sprocket shafts 112 may be maintained. Drive sprocket shafts 112 are generally fixed in position relative to the outer plates 76 and 78. Idler sprocket shafts 122 are vertically adjustable so that proper chain tension can be achieved.

The roller chain drive system 108 is rigidly positioned in each carriage 46 between outer plates 76 and 78. Roller chain drive system 108 includes a linear or pressure beam 150 rigidly fixed to the outer plates 76 and 78 of each carriage 46. Linear beam 150 may be rigidly attached to the carriage 46 with bolts extending through outer plates 76 and 78. A working length 158 is defined on the linear beam 150. A pair of spaced upper roller chain sprockets (not shown) of roller chain 172 are rotatably disposed on an upper end of the linear beam 150, and a pair of spaced lower roller chain sprockets (not shown) of the roller chain 172 are rotatably disposed on a lower end of the linear beam 150. The roller chain 172 engages the upper and lower roller chain sprockets. An outer side of the roller chain 172 engages with an inner side of gripper chain 126. Lower roller chain sprockets incorporate a tensioner (not shown), of a type known in the art to keep the proper tension on roller chain 172.

Gripper cylinders 66 may include a plurality of, and preferably four, hydraulic actuator cylinders (shown as 185, 188). As shown in FIG. 2, the injector 10 may include upper cylinders 185 and lower cylinders 188. In an embodiment, actuator mounting plates 190 and 192 having clevis lugs 191 and 193, respectively, extending therefrom are rigidly mounted to outer plates 76 and 78. The ends of cylinders 185 and 188 are attached to clevis lugs 191 and 193, respectively. Actuator mounting plates 190 and 192 may be attached utilizing bolts or other means known in the art which extend through the actuator mounting plates 190 and 192 and the outer plates 76 and 78 of carriages 72 and 74, respectively. The cylinders 185, 188 may be simultaneously actuated to pull the outer plates 76, 78 and corresponding carriages 72 and 74 respectively closer or push them apart. Pulling the carriages 72 and 74 closer causes the respective linear beams 150 of each carriage 72 and 74 to push the respective roller chains 172 on to the gripper chains 126, thus causing the gripper blocks 128 to apply a higher gripping force on the outer diameter of the tubing 18. On the other hand, pushing the carriages 72 and 74 apart in turn causes the linear beams 150 of each carriage 72 and 74 to push the respective roller chains 172 away from the gripper chains 126, thus causing the gripper blocks 128 to apply a lower gripping force on the outer diameter of the tubing 18.

In operation, when it is desired that tubing 18 be lowered, raised, or suspended in the well 13, actuator cylinders 185, 188 may be actuated until gripper blocks 128 engage tubing 18. Gripper chains 126 may engage tubing 18 along the working length 158 of the linear beams 150 and a corresponding working length 252 of the roller chain 172. Thus, gripper chains 126 will first contact the tubing 18 at an upper end of the working length 158 of linear beam 150, and the contact between the tubing 18 and gripper chains 126 breaks away as the tubing 18 passes a lower end of working length 158. For example, a gripper operating pressure may be adjusted by an operator in the operator cabin which adjusts the hydraulic pressure on each of the gripper cylinders 185 and 188 causing the cylinders to pull the carriages 72 and 74 towards each other. Thus, the pressure adjustment on the gripper cylinders 185 and 188 translates into a corresponding force that is applied on the linear beams 150. The linear beams 150 in turn apply a uniform radial force on the gripper chains 126 by pressing the roller chains 172 against the gripper chains 126 resulting in the gripper blocks 128 being pressed against the coiled tubing 18 with an increased force.

Coiled tubing grippers 128 serve a critical purpose in all well intervention operations involving the insertion of coiled tubing string 18 down the wellbore 13 or pulling out of the coiled tubing string 18 up the wellbore 13. The gripper blocks 128 are used to firmly grasp the coiled tubing string 18 as the gripper chains 126 drive the coiled tubing string 18 while running into a wellbore or pulling out of a wellbore. The force, F, exerted via the gripper blocks 128 on the coiled tubing string 18 needs to be high enough to prevent pipe slippage when a hoisting load is applied, but not so much as to damage the coiled tubing string 18, for example, by either increasing ovality, deformation or increasing pipe fatigue. Thus, an actual gripping force applied by the grippers 128 onto the coiled tubing 18 should be between a minimum force value required to avoid pipe slippage and a maximum force value over which pipe damage may occur.

Generally, the minimum force that is to be applied by the gripper blocks 128 onto the coiled tubing 18 to avoid pipe slippage varies during a coiled tubing injector operation based on a coiled tubing hoisting load held by the injector 10 at any stage during the injector operation. Hoisting load generally depends at least on the weight of the coiled tubing 18 underneath the injector 10 which may be measured by a load cell disposed at the base of the injector 10. For example, when coiled tubing 18 is being lowered into the wellbore 13, as more coiled tubing 18 is lowered, the hoisting load on the injector increases due to the additional weight of the coiled tubing supported by the injector 10. A higher hoisting load means a higher amount of traction force must be applied by the gripper blocks 128 onto the coiled tubing 18 to support the additional weight and avoid pipe slippage. Other parameters such as a friction factor of the coiled tubing 18 and wear of the gripper blocks may also need to be considered when determining the minimum force to be applied by the gripper blocks 128 at any stage during the operation of the coiled tubing injector 10.

The maximum force that can be applied by the gripper blocks 128 onto the coiled tubing 18 without damaging the coiled tubing 18 also varies based on the properties of the section of the coiled tubing 18 currently passing through the injector 10. For example, the wall thickness of the coiled tubing 18 may vary along the length of the coiled tubing 18. In some cases, a coiled tubing 18 may have up to 8 or 10 different wall thicknesses along the entire length of the coiled tubing 18. A lower amount of force may damage a section of the coiled tubing 18 having a lower wall thickness as compared to another section of the coiled tubing 18 that can withstand a higher amount of force due to a higher wall thickness.

Thus, since the minimum required force to avoid pipe slippage and the maximum recommended force to avoid pipe damage may change during an injector operation, the operating pressure on the gripper cylinders 185 and 188 may need to be monitored and adjusted accordingly throughout the injector operation so that the operating pressure on the gripper cylinders 185 and 188 translates into a gripping force applied by the gripper block 128 that lies between the current minimum and maximum force values recommended for the current section of the coiled tubing passing through the injector 10.

In present coiled tubing injector systems, adjustment of the operating gripping pressure on the gripper cylinders 185 and 188 is performed manually. For example, an operator sitting in the operator cabin manually turns a valve provided in the operator cabin to adjust the gripping pressure of the gripper cylinders to a pressure value, based on past operator experience and some basic guidelines including pressure look-up tables. For example, in present injector systems, the operator has access to look-up tables that provide recommended minimum and maximum pressure values calculated based on properties of the coiled tubing 18, surface equipment properties related to the injector 10, and measured parameters related to a job being performed by the injector system 100 (e.g., hoisting load). For example, minimum pressure values provided in the look-up table may have been calculated based at least on a current hoisting load. Similarly, the maximum pressure values provided in the look-up table may have been calculated based at least on one or more coiled tubing parameters related to the portion of the coiled tubing passing the injector including the wall thickness of the coiled tubing. One or more other parameters relating to the injector system, coiled tubing properties and a current injector job being performed may also be used to calculate the minimum and maximum pressure values. The operator generally selects an operating gripping pressure to set for the gripper cylinders 185 and 188 at any stage during an injector operation by selecting a pressure value that is between the recommended minimum and maximum pressure values (e.g., as provided by the pressure look-up table(s)) based on past experience. The manually selected operating pressure is not always the most optimal pressure value for the given set of conditions as it is based on the operator's past experience and not based on concrete guidelines and/or data relating to optimal operating pressures for the given set of conditions.

Monitoring the coiled tubing injector operation and manually determining and setting of the operating pressures for the gripper cylinders 185 and 188 places considerable burden on the operator throughout the coiled tubing injector operation. Further, as the pressure values are manually determined based on operator's past experience and other crude guidelines, the operating gripping pressure set for the gripping cylinders 185 and 188 is not always the optimal pressure for the give set of conditions.

Aspects of the present disclosure discuss techniques for automatically monitoring one or more parameters related to a coiled tubing injector operation, intelligently selecting an appropriate gripping pressure for the gripping cylinders (e.g., 185 and 188) of the injector (e.g., injector 10) and automatically setting the selected gripping pressure for the one or more gripping cylinders of the injector.

Figure 3:
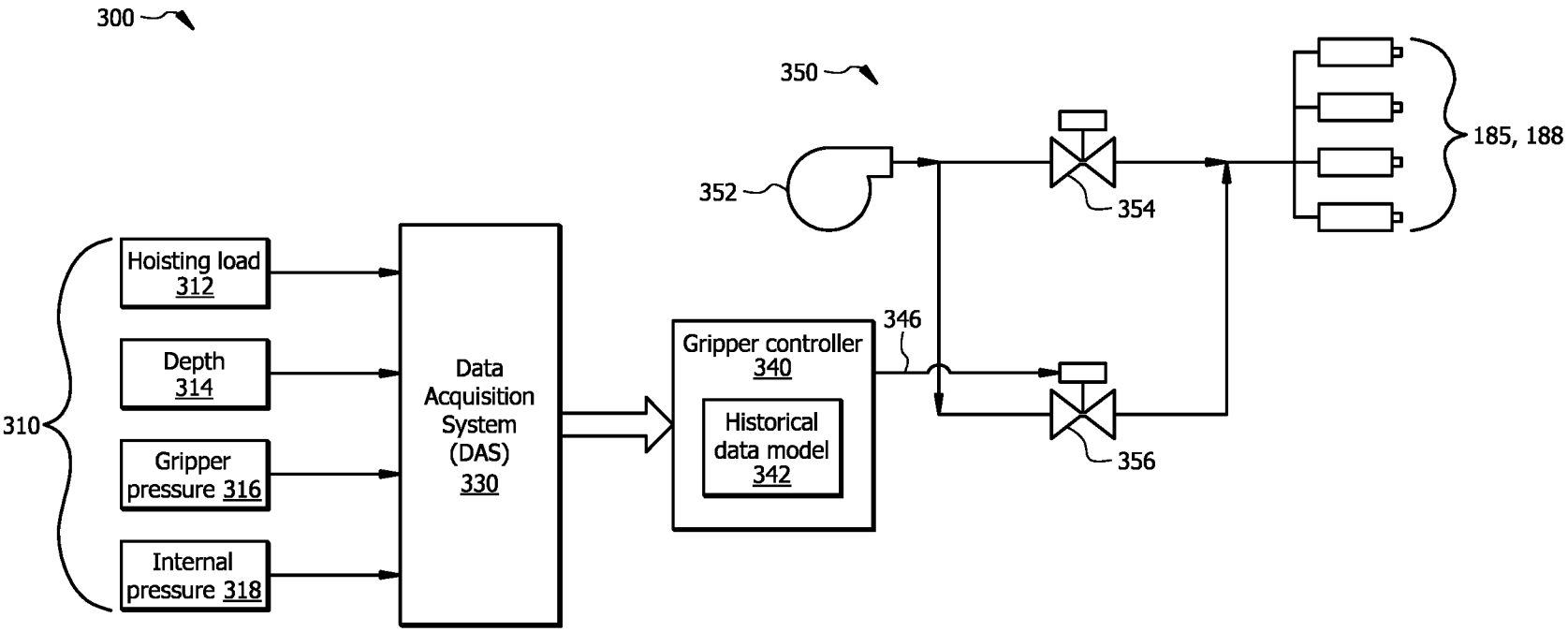
FIG. 3 illustrates a schematic diagram of an example system for adjusting gripper pressure in a coiled tubing injector system of FIG. 1, in accordance with one or more embodiments of the present disclosure.

FIG. 3 illustrates a schematic diagram of an example system 300 for adjusting gripper pressure in a coiled tubing injector system 100, in accordance with one or more embodiments of the present disclosure.

As shown in FIG. 3, system 300 includes a data acquisition system (DAS) 330, a gripper controller 340 and a hydraulic gripper control circuit 350. DAS 330 may be configured to collect data relating to properties of the coiled tubing 18, surface equipment properties including properties of the injector 10 and measured parameters during a coiled tubing injector operation. For example, as shown in FIG. 3, system 300 may include a plurality of sensors 310 measuring various parameters related to the coiled tubing injector operation and feeding the measured data to the DAS 330. As shown, sensors 310 may measure the hoisting load 312, depth 314, gripper pressure 316 and coiled tubing internal pressure 318. Hoisting load 312 generally depends at least on the weight of the coiled tubing 18 underneath the injector 10. The hoisting load 312 may be measured by a load cell disposed at the base of the injector 10. The load cell provides a signal relative to weight of the coiled tubing 18 that has passed the injector 10. Depth 314 may refer to a length of the coiled tubing 18 in the wellbore 13. The depth 314 may be used to determine properties (e.g., coiled tubing wall thickness) of a section of the coiled tubing currently passing through the injector 10. For example, the section of the coiled tubing 18 passing through the injector 10 may be identified based on the measured depth of the coiled tubing. The depth 314 of the coiled tubing 18 may be measured by a depth sensor. Gripper pressure 316 may represent a current pressure at which the gripper cylinders 185 and 188 are operating. The gripper pressure 316 may be measured by a pressure transducer. The coiled tubing internal pressure 318 may represent internal pressure of a fluid being pumped through the coiled tubing 18 at any given time. The internal pressure may be measured by an appropriate pressure transducer known in the art.

The measured values of hoisting load 312, depth 314, gripper pressure 316 and coiled tubing internal pressure 318 are fed into the DAS 330. DAS 330 may be configured to additionally obtain several parameters related to properties of the coiled tubing 18 and the injector 10. These parameters may include, but are not limited to outer diameter (D) of the coiled tubing 18, thickness (t) of the coiled tubing 18 (including data relating to which sections of the coiled tubing 18 have what thickness), length (L) of the linear beam 150, area (A) of the gripper cylinders 185 and 188, efficiency ($\eta$) of the cylinder, coiled tubing axial stress ($\sigma_x$) caused by coiled tubing hoisting load 312 and coiled tubing internal pressure 318, yield strength ($\sigma_{ys}$) of the coiled tubing 18. In an additional or alternative embodiment, the gripper controller 340 may be configured to directly obtain one or more of the above described parameters (including corresponding parameter values). For example, the gripper controller 340 may directly obtain measured values of hoisting load 312, depth 314, gripper pressure 316 and coiled tubing internal pressure 318 from respective sensors. The gripper controller 340 may also be configured to obtain and/or determine one or more parameters (including corresponding parameter values) relating to properties of the coiled tubing 18 and injector 10.

DAS 330 may further be configured to obtain a historical data model 342 including data relating to target gripper pressures previously set for the gripper cylinders 185 and 188 for a given set of parameters and/or corresponding target gripping forces previously applied to the gripper chains 126 for the given set of parameters. The gripper pressures and gripping forces provided by the historical data model 342 for each set of parameter values include gripper pressure values and gripping force values that were determined to be optimal for the set of parameter values. For example, the gripping pressures and gripping forces provided by the historical model 342 did not result in pipe slippage or caused pipe damage when applied for the corresponding set of parameter values.

The historical data model 342 may include data collected over a given time period (days, weeks, months or years) while conducting coiled tubing injector operations by the coiled tubing system 100 and/or by one or more other coiled tubing injector systems having similar properties including coiled tubing properties (e.g., coiled tubing outer diameter (D), coiled tubing thickness (t), coiled tubing yield strength ($\sigma_{ys}$) etc.) and surface equipment properties (e.g., injector properties including length (L) of the linear beam 150, area (A) of the gripper cylinders 185 and 188, efficiency ($\eta$) of the cylinder etc.).

For example, for a given set of parameters, the historical data model 342 may include target gripper pressures applied to the gripper cylinders 185 and 188 and corresponding target gripping forces resulting from the application of the target gripper pressure. The set of parameters may relate to a coiled tubing injector operation and may include one or more of hoisting load 312, depth 314, gripper pressure 316, coiled tubing internal pressure 318, outer diameter (D) of the coiled tubing 18, thickness (t) of the coiled tubing 18 (including which sections of the coiled tubing 18 have what thickness), length (L) of the linear beam 150, area (A) of the gripper cylinders 185 and 188, efficiency (η) of the cylinder, coiled tubing axial stress ($\sigma_x$) caused by coiled tubing hoisting load 312 and coiled tubing internal pressure 318, yield strength ($\sigma_{ys}$) of the coiled tubing 18. The historical data model 342 may include target gripper pressures and/or corresponding target gripping forces for different combinations of the one or more parameters. Further, the historical data model 342 may include target gripper pressures and/or corresponding target gripping forces for different combinations of values for a given set of parameters. For example, the historical data model 342 may include one or more previously set target gripper pressures and/or one or more corresponding target gripping forces applied for a given coiled tubing outer diameter (D), coiled tubing thickness (t), coiled tubing yield strength ($\sigma_{ys}$), hoisting load 312 and internal pressure 318.

In one embodiment, the DAS 330 may be configured to obtain the historical data model 342 (e.g., from a data server, another computing system, via download from a portable data storage device etc.) and send the obtained historical data model 342 to the gripper controller 340. The gripper controller 340 may be configured to locally store the historical data model 342 in a memory of the gripper controller 340. In an alternative embodiment, gripper controller 340 may be configured to directly obtain the historical data model 342 and store the obtained data model 342 in a local memory device of the gripper controller 340.

Gripper controller 340 may be configured to monitor operation of the injector 10 based on values of one or more parameters obtained from the DAS 330 and determine an optimized gripper pressure to be set for the gripper cylinders 185 and 188. The gripper controller 340 may be configured to generate an electronic signal 346 based on the determined optimized target gripper pressure and send out the electronic signal 346 to the hydraulic gripper control circuit 350.

The gripper control circuit 350 is designed to adjust gripper pressure of the gripper cylinders 185 and 188. As shown in FIG. 3, the gripper control circuit 350 includes a hydraulic pump 352 that provides hydraulic pressure for operating the gripper control circuit 350. An electronically controlled electro-hydraulic valve 356 may be configured to receive a set-point for the target gripper pressure from the gripper controller 340 as an electronic signal and, in response, automatically actuate the valve 356 to regulate the pressure in the circuit 350 until the target set-point is reached in the hydraulic gripper cylinders 185 and 188. A manually controlled hydraulic valve 354 may be connected in parallel to the electro-hydraulic valve 356 and can be used to manually adjust the hydraulic pressure of the gripper cylinders 185 and 188, thereby providing manual over-ride capability to an operator.

Gripper controller 340 may be configured to determine an operating pressure window for the gripper cylinders 185 and 188 at any stage during the injector operation, and then determine an optimized target gripper pressure to be applied to the gripper cylinders 185 and 188 based on the historical data model 342. To determine the operating pressure window, the gripper controller 340 may be configured to determine a minimum gripper pressure that is to be applied to the gripper cylinders 185, 188 to avoid pipe slippage and a maximum allowed gripper pressure that can be applied to the gripper cylinders 185, 188 to avoid pipe damage. As described above, the gripper pressure set for the gripper cylinders 185 and 188 controls the gripping force applied to the gripper chains 126. Thus, the operating window for the gripper pressure defines an operating window for the gripping force. The gripper controller 340 may select a target gripper pressure that lies within the determined pressure window and is optimized based on the historical data model 342. By determining the gripper pressure window, gripper controller 340 avoids the target gripper pressure from being set too low resulting in pipe slippage or set too high to damage the coiled tubing 18. The historical data model 342 provides the gripper controller benefit of past experiences under similar conditions and a concrete guide to what target gripping pressures can be optimal for the given conditions. For example, as described above, the historical data model provides gripper pressure values and/or corresponding gripping force values that were determined to be optimal for a given set of conditions (e.g., parameter values). Optimizing the target gripper pressure to be set for the gripper cylinders 185 and 188 based on the historical data model 342 helps minimize pipe damage. In one or more embodiments, the gripper controller 340 may be configured to continuously monitor one or more parameters obtained from the DAS 330 and adjust the target gripper pressure as needed when an injector operation is in progress. For example, the gripper controller 340 may be configured to determine and adjust the target gripper periodically, randomly or based on a preselected schedule. The entire operation including monitoring the parameters related to the operation of the injector 10, determining the gripper pressure window, selecting an optimized target gripper pressure and adjusting the target gripper pressure for the gripper cylinders 185 and 188 is designed to be fully automatic and not needing operator intervention. Thus, the disclosed system and methods significantly reduce operator burden. Further, by determining optimized gripper pressure values in accordance with techniques disclosed herein, the disclosed system and methods avoid the gripper pressure from being set too low resulting in pipe slippage or too high resulting in pipe damage. Further, the adjustment of the gripper pressure throughout the operation of the injector 10 may ensure minimal damage to the coiled tubing 18.

Gripper controller 340 may be configured to determine the minimum gripper pressure that is to be applied to the gripper cylinders 185 and 188 in accordance with methods known in the art. For example, the gripper controller 340 may determine the minimum gripper pressure at any time during the operation of the injector 10 based at least on the measured hoisting load 312 at that time as received from the DAS 330. In one embodiment, the gripper controller 340 may calculate a minimum gripping force that is to be applied to the gripper chains 126 and then calculate a corresponding minimum gripper pressure that is to be applied to the gripper cylinders 185 and 188 as a function of the minimum gripping force.

Gripper controller 340 may be configured to determine the maximum allowed gripper pressure that can be applied to the gripper cylinders 185 and 188 based on values of a plurality of parameters obtained from the DAS 330. In one embodiment, the gripper controller 340 may calculate a maximum gripping force that can be applied by the gripper chains 126 onto the coiled tubing 18 in accordance with equation (1) as shown below.

$$F_y = \frac{-C_1(2C_2 - \sigma_x) + \sqrt{[(C_1(2C_2 - \sigma_x)]^2 - 4C_1^2(\sigma_x^2 + C_2^2 - \sigma_x C_2 - \sigma_{YS}^2)}}{2C_1^2} \quad (1)$$

wherein:

$F_y$—the maximum gripping force that can be applied to the gripper chains 126;

$\sigma_x$—coiled tubing pipe axial stress caused by hoisting load 312 and internal pressure 318 of the coiled tubing 18;

$\sigma_{ys}$—yield strength of the coiled tubing 18;

$C_1$—a constant accounting for properties of the coiled tubing 18 including one or more of outer diameter and wall thickness of the coiled tubing 18; and $C_2$—a constant accounting for surface measurements of one or more parameters including one or more of hoisting load 312 and internal pressure 318 of the coiled tubing 18.

It may be noted that, unlike the above equation (1) used to calculate the maximum griping force in accordance with embodiments of the present disclosure, present systems do not consider the hoisting load 312 and/or the internal pressure 318 of the coiled tubing 18 to calculate the maximum gripper pressure or the maximum gripping force that can be applied to the injector 10. Both the hoisting load 312 and internal pressure 318 of the coiled tubing 18 at any time during an injector operation can affect the maximum gripper pressure or resulting gripping force that can be applied to the injector 10. Thus, not considering the hoisting load 312 and/or internal pressure 318 when calculating the maximum gripper pressure or resulting gripping force can lead to an erroneous (or less accurate) determination of the maximum gripper pressure or the maximum gripping force which can potentially lead to pipe damage. The weight on the coiled tubing 18 as a result of the hoisting load 312 and the internal pressure 318 of the coiled tubing 18 create axial stresses on the coiled tubing 18 which affect the maximum amount of gripping force that can be applied to the coiled tubing 18 before it starts to damage. For example, a larger hoisting load may create a higher axial stress on the coiled tubing pipe which may lower maximum gripping force. A higher internal pressure of a fluid inside the pipe opposes at least a portion of the gripping force applied onto the pipe by the gripper chains 126, which may raise the maximum gripping force that can be applied to the coiled tubing pipe. Thus, considering the hoisting load 312 and the internal pressure 318 of the coiled tubing 18 when calculating the maximum gripping force may yield a more accurate value of the maximum gripping force which may help avoid damage to the coiled tubing 18.

The gripper controller 340 may determine a maximum gripper pressure as a function of the maximum gripper force ($F_y$) according to equation (2) as shown below.

$$P_y = \frac{F_y}{A\eta} \tag{2}$$

wherein:

$P_y$—the maximum gripper pressure that can be set for the gripper cylinders 185 and 188;

A—area of the gripper cylinders 185 and 188; and $\eta$—efficiency of the gripper cylinders 185 and 188.

Once the minimum and maximum gripping forces are calculated, the gripper controller 340 may determine an estimated gripping force that can be applied to the gripper chains 126. In one or more embodiments, the gripper controller 340 selects an estimated gripping force value that lies within an operating gripping force window defined by the calculated minimum and maximum gripping force. For example, the gripper controller 340 may be configured to select a value of the estimated gripping force as a pre-configured percentage of the calculated maximum gripping force so that the selected estimated gripping force lies within the gripping force window. In one embodiment, the percentage of the maximum gripping force may be configured by the operator.

The gripper controller 340 may be configured to determine a target gripping force that is to be applied to the gripper chains 126, by adjusting the estimated gripping force based on the historical data model 342. In one embodiment, the gripper controller 340 may adjust the estimated gripping force based on one or more previously applied target gripping forces (as provided by the historical data model 342) corresponding to the same or similar parameter values based on which the gripper controller 340 calculated the minimum gripper force, the maximum gripper force and determined the estimated gripping force. For example, the gripper controller 340 may extract from the historical data model 342 one or more previously applied target gripping force values corresponding to the same coiled tubing outer diameter, coiled tubing thickness, linear beam length, hoisting load and internal pressure based on which the gripper controller 340 calculated the minimum gripper force, the maximum gripper force and determined the estimated gripping force. The previously applied one or more gripping forces extracted from the historical data model 342 may be representative of optimal values of the gripping forces applied on previous occasions (e.g., to injector 10 or other injectors having similar properties) for the same or similar parameter values.

In one or more embodiments, the gripper controller 340 may be configured to determine an adjustment factor by comparing the estimated target gripping force and the one or more previously applied target gripping forces from the historical data model 342. The gripper controller 340 may be configured to apply the adjustment factor to the estimated gripping force to determine the target gripping force to be applied to the gripper chains 126. The gripper controller 340 may determine the adjustment factor as a difference between the estimated gripping force and at least one previously applied target gripping force from the historical data model. This difference may be used to adjust the value of the estimated gripping force and determine the target gripping force to apply to the gripping chains 126. For example, when the estimated gripping force is 3000 newton and a previously applied target gripping force from the historical data model 342 is 3500 newton, the adjustment factor can be determined as 500, which can be added to the estimated gripping force to determine a target gripping force of 3500 newton. In one embodiment, when the historical data model provides several values of previously applied target gripping forces for the same set of parameter values, the grippier controller 340 may calculate an average of the previously applied values and determine the adjustment factor as a difference between the estimated gripping force and the average value of the previously applied target gripping forces. In one embodiment, the gripper controller 340 may be configured to limit the adjustment factor to a maximum value (e.g., a maximum amount of adjustment) to avoid large adjustments from being made at one time.

Once the target gripping force is determined, the gripper controller 340 may determine the target gripping pressure as a function of the target gripping force. The gripper controller may send an electronic signal to the gripper control circuit 350 (e.g., to electro-hydraulic valve 356) to adjust the gripping pressure of the gripper cylinders 185 and 188 to the determined target gripper pressure. For example, the gripper controller 340 may be configured to calculate the target gripper pressure according to equation (3) as shown below.

$$P_T = \frac{F_T}{A\eta} \tag{3}$$

wherein:

$P_T$—the target gripper pressure that is to be set for the gripper cylinders 185 and 188;

$F_T$—the target gripping force that is to be applied by the gripper chains onto the coiled tubing 18;

A—area of the gripper cylinders 185 and 188; and

η—efficiency of the gripper cylinders 185 and 188.

The gripper controller 340 may be configured to continuously monitor parameters related to the injector operation and fine tune the gripper pressure as needed (e.g., by determining target gripping forces and gripper pressures as described above) to ensure that an optimal force continues to be applied by the gripper chains 126 onto the coiled tubing 18 as values of one or more parameters change during the duration of the injector operation.

In one or more embodiments, the gripper controller 340 may be configured to add the determined target gripping force and the corresponding target gripper pressure to the historical data model 342 for subsequent use in determining gripping force and gripper pressure.

In one or more embodiments, the gripper controller 340 may be implemented by an artificial intelligence (AI) model. The AI model may be trained using historical data relating to the previously set gripper pressures and corresponding applied gripping forces from the historical data model 342. The trained AI model may be used to determine optimized gripping forces and gripper pressures in real world conditions. The gripper controller 340 may be configured to constantly update the AI model by adding newly set gripper pressures and corresponding applied gripping forces to the historical data model 342 and updating the training of the AI model based on the updated historical data model 342. As more real-time data relating to gripper pressures and gripping forces is added to the historical data model 342, the AI model may update itself thereby increasing the accuracy of determining optimized gripping force and gripper pressure values for a given set of parameter values.

Figure 4:
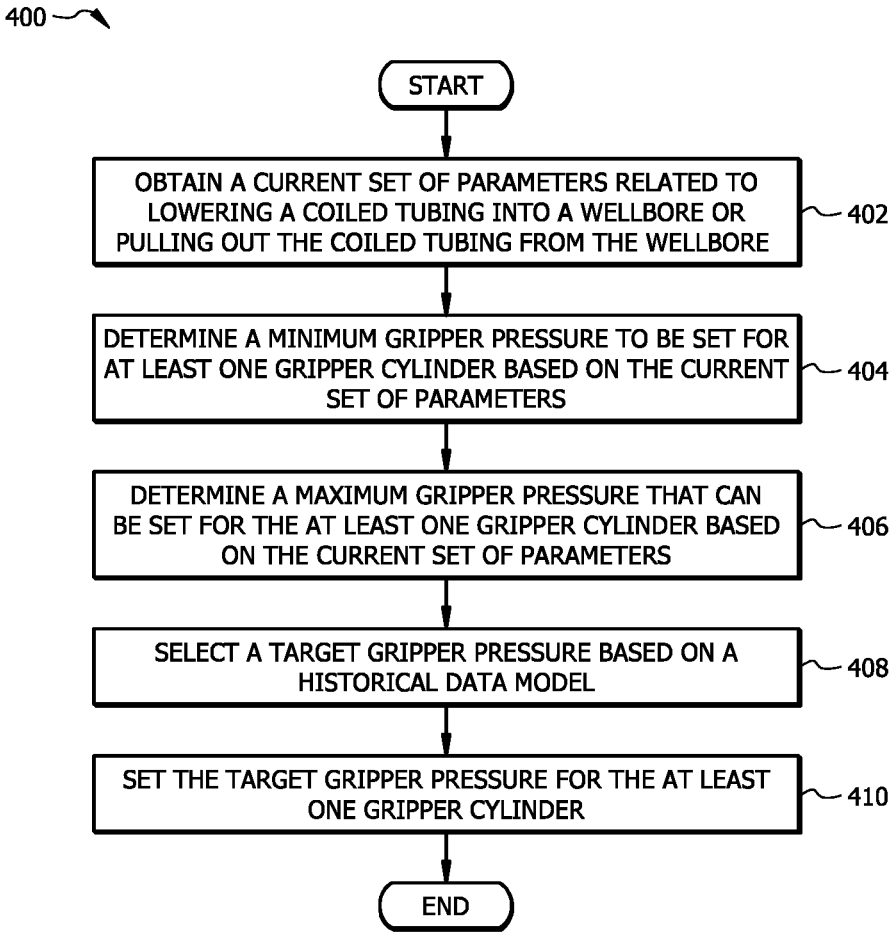
FIG. 4 illustrates example operation for determining an optimized gripper pressure to be applied for an injector of FIG. 1, in accordance with one or more embodiments of the present disclosure.

FIG. 4 illustrates example operation 400 for determining an optimized gripper pressure to be applied for an injector 10, in accordance with one or more embodiments of the present disclosure. Operations 400 may be implemented by a gripper controller 340 as discussed above with reference to FIG. 3.

At step 402, gripper controller 340 obtains a current set of parameters related to lowering the coiled tubing 18 into a wellbore 13 or pulling out the coiled tubing 18 from the wellbore 13.

As described above, a coiled tubing injector system 100 includes an injector 10 (also referred to as an injector head) mounted above a wellhead 12. Injector 10 utilizes a pair of opposed endless drive chains or gripper chains 126 which are arranged in a common plane. Each of the gripper chains 126 has a multitude of gripper blocks 128 attached therealong. The gripper chains 126 are driven by respective drive sprockets 110 which are in turn powered by a reversible hydraulic motor. The opposed gripper chains 126, via the gripper blocks 128, sequentially grasp the coiled tubing 18 that is positioned between the opposed gripper chains 126. When the gripper chains 126 are in motion, each gripper chain 126 has a gripper block 128 that is coming into contact with the coiled tubing 18 as another gripper block 128 on the same gripper chain 126 is breaking contact with the coiled tubing 18. This continues in an endless fashion as the gripper chains 126 are driven to force the coiled tubing 18 into or out of the wellbore 13, depending on the direction in which the drive sprockets 110 are rotated. Each gripper chain 126 is provided with a predetermined amount of slack which allows the gripper chain 126 to be biased against the coiled tubing 18 to inject the coiled tubing 18 into and out of the wellbore 13. This biasing is accomplished with an endless roller chain 172 disposed inside each gripper chain 126. Each roller chain 172 engages sprockets rotatably mounted on a respective linear beam 150. A linkage and hydraulic gripper cylinder (e.g., 185 and 188) mechanism allows the linear beams 150 to be moved toward one another so that each roller chain 172 is moved against its corresponding gripper chain 126 such that the coiled tubing 18 facing portion of the gripper chain 126 is moved toward the coiled tubing 18 so that the gripper blocks 128 can engage the tubing 18 and move it through the injector 10. The gripper blocks 128 engage the tubing 18 along a working length 158 of the linear beam 150. Each gripper chain 126 has a gripper block 128 that contacts the tubing 18 at the top of the working length 158 as a gripper block 128 on the same gripper chain 126 is breaking contact at a bottom of the working length 158 of the linear beam 150.

In operation, when it is desired that tubing 18 be lowered, raised, or suspended in the well 13, actuator cylinders 185, 188 may be actuated until gripper blocks 128 engage tubing 18. Gripper chains 126 may engage tubing 18 along the working length 158 of the linear beams 150 and a corresponding working length 252 of the roller chain 172. Thus, gripper chains 126 will first contact the tubing 18 at an upper end of the working length 158 of linear beam 150, and the contact between the tubing 18 and gripper chains 126 breaks away as the tubing 18 passes a lower end of working length 158. For example, a gripper operating pressure may be adjusted by an operator in the operator cabin which adjusts the hydraulic pressure on each of the gripper cylinders 185 and 188 causing the cylinders to pull the carriages 72 and 74 towards each other. Thus, the pressure adjustment on the gripper cylinders 185 and 188 translates into a corresponding force that is applied on the linear beams 150. The linear beams 150 in turn apply a uniform radial force on the gripper chains 126 by pressing the roller chains 172 against the gripper chains 126 resulting in the gripper blocks 128 being pressed against the coiled tubing 18 with an increased force. In one or more embodiments, the arrangement of components including the linear beam 150, roller chains 172 and gripper cylinders 185 and 188 that help generate a gripping force applied to the gripper chains 126 as a result of hydraulic pressure set for the gripper cylinders 185 and 188 may generally be referred to as the gripper system.

As described above with reference to FIG. 3, the gripper controller 340 may be configured to monitor operation of the injector 10 based on values of one or more parameters obtained from the DAS 330 and determine an optimized gripper pressure to be set for the gripper cylinders 185 and 188. The gripper controller 340 may be configured to generate an electronic signal 346 based on the determined optimized target gripper pressure and send out the electronic signal 346 to the hydraulic gripper control circuit 350.

In one embodiment, the gripper controller 340 obtains at least a portion of the current set of parameters (e.g., including parameter values of one or more of the parameters) from the DAS 330. DAS 330 may be configured to collect data including several parameters (and corresponding parameter values) relating to properties of the coiled tubing 18, surface equipment properties including properties of the injector 10 and measured parameters during a coiled tubing injector operation. For example, DAS 330 may collect measured values of one or more parameters including hoisting load 312, depth 314, gripper pressure 316 and coiled tubing internal pressure 318 from respective sensors measuring these parameters. DAS 330 may be configured to additionally obtain several parameters (and corresponding parameter values) related to properties of the coiled tubing 18 and the injector 10. These parameters may include, but are not limited to outer diameter (D) of the coiled tubing 18, thickness (t) of the coiled tubing 18 (including data relating to which sections of the coiled tubing 18 have what thickness), length (L) of the linear beam 150, area (A) of the gripper cylinders 185 and 188, efficiency ($\eta$) of the cylinder, coiled tubing axial stress ($\sigma_x$) caused by coiled tubing hoisting load 312 and coiled tubing internal pressure 318, yield strength ($\sigma_{ys}$) of the coiled tubing 18. In an additional or alternative embodiment, the gripper controller 340 may directly obtain one or more of the above described parameters (including corresponding parameter values). For example, the gripper controller 340 may directly obtain measured values of hoisting load 312, depth 314, gripper pressure 316 and coiled tubing internal pressure 318 from respective sensors. The gripper controller 340 may also obtain and/or determine one or more parameters (including corresponding parameter values) relating to properties of the coiled tubing 18 and injector 10.

The current set of parameters obtained by the gripper controller 340 may include one or more of the above described parameters (including values of the one or more parameters) relating to a current injector job and/or a current stage of the injector job being performed by the injector 10. For example, the current set of parameters may include values of one or more parameters relating to properties of a section of coiled tubing 18 currently passing through the injector 10.

At step 406, the gripper controller 340 determines a minimum gripper pressure to be set for at least one gripper cylinder 185 and 188, based on the current set of parameters (including values of the parameters) obtained by the gripper controller 340.

As described above, gripper controller 340 may be configured to determine an operating pressure window for the gripper cylinders 185 and 188 at any stage during the injector operation, and then determine an optimized target gripper pressure to be applied to the gripper cylinders 185 and 188 based on the historical data model 342. To determine the operating pressure window, the gripper controller 340 may be configured to determine a minimum gripper pressure that is to be applied to the gripper cylinders 185, 188 to avoid pipe slippage and a maximum allowed gripper pressure that can be applied to the gripper cylinders 185, 188 to avoid pipe damage. As described above, the gripper pressure set for the gripper cylinders 185 and 188 controls the gripping force applied to the gripper chains 126. Thus, the operating window for the gripper pressure defines an operating window for the gripping force. The gripper controller 340 may select a target gripper pressure that lies within the determined pressure window and is optimized based on the historical data model 342.

Gripper controller 340 may be configured to determine the minimum gripper pressure that is to be applied to the gripper cylinders 185 and 188 in accordance with methods known in the art. For example, the gripper controller 340 may determine the minimum gripper pressure at any time during the operation of the injector 10 based at least on the measured hoisting load 312 at that time as received from the DAS 330. In one embodiment, the gripper controller 340 may calculate a minimum gripping force that is to be applied to the gripper chains 126 and then calculate a corresponding minimum gripper pressure that is to be applied to the gripper cylinders 185 and 188 as a function of the minimum gripping force.

At step 406, the gripper controller 340 determines a maximum gripper pressure that can be set for the at least one gripper cylinder 185 and 188 based on the current set of parameters (including values of the parameters).

Gripper controller 340 may be configured to determine the maximum allowed gripper pressure that can be applied to the gripper cylinders 185 and 188 based on values of a plurality of parameters obtained from the DAS 330. In one embodiment, the gripper controller 340 may calculate a maximum gripping force that can be applied by the gripper chains 126 onto the coiled tubing 18 in accordance with equation (1) as shown below.

$$F_y = \frac{-C_1(2C_2 - \sigma_x) + \sqrt{[(C_1(2C_2 - \sigma_x)]^2 - 4C_1^2(\sigma_x^2 + C_2^2 - \sigma_x C_2 - \sigma_{YS}^2)}}{2C_1^2} \quad (1)$$

wherein:

$F_y$—the maximum gripping force that can be applied to the gripper chains 126;

$\sigma_x$—coiled tubing pipe axial stress caused by hoisting load 312 and internal pressure 318 of the coiled tubing 18;

$\sigma_{ys}$—yield strength of the coiled tubing 18;

$C_1$—a constant accounting for properties of the coiled tubing 18 including one or more of outer diameter and wall thickness of the coiled tubing 18; and $C_2$—a constant accounting for surface measurements of one or more parameters including one or more of hoisting load 312 and internal pressure 318 of the coiled tubing 18.

The gripper controller 340 may determine a maximum gripper pressure as a function of the maximum gripper force ($F_y$) according to equation (2) as shown below.

$$P_y = \frac{F_y}{A\eta} \quad (2)$$

wherein:

$P_y$—the maximum gripper pressure that can be set for the gripper cylinders 185 and 188;

A—area of the gripper cylinders 185 and 188; and $\eta$—efficiency of the gripper cylinders 185 and 188.

At step 408, the gripper controller 340 selects a target gripper pressure between the minimum gripper pressure and the maximum gripper pressure based on a historical data model 342 including, corresponding to the current set of parameters, one or more of a plurality of target gripping forces previously applied to the gripper chains 126 and a plurality of corresponding target gripper pressures previously set for the gripper cylinders 185 and 188.

At step 410, the gripper controller 340 sets the determined target gripper pressure for the gripper cylinders 185 and 188 to apply a corresponding gripping force to the gripper chains 126.

As described above, once the minimum and maximum gripping forces are calculated, the gripper controller 340 may determine an estimated gripping force that can be applied to the gripper chains 126. In one or more embodiments, the gripper controller 340 selects an estimated gripping force value that lies within an operating gripping force window defined by the calculated minimum and maximum gripping force. For example, the gripper controller 340 may be configured to select a value of the estimated gripping force as a pre-configured percentage of the calculated maximum gripping force so that the selected estimated gripping force lies within the gripping force window. In one embodiment, the percentage of the maximum gripping force may be configured by the operator.

The gripper controller 340 may be configured to determine a target gripping force that is to be applied to the gripper chains 126, by adjusting the estimated gripping force based on the historical data model 342. In one embodiment, the gripper controller 340 may adjust the estimated gripping force based on one or more previously applied target gripping forces (as provided by the historical data model 342) corresponding to the same or similar parameter values based on which the gripper controller 340 calculated the minimum gripper force, the maximum gripper force and determined the estimated gripping force. For example, the gripper controller 340 may extract from the historical data model 342 one or more previously applied target gripping force values corresponding to the same coiled tubing outer diameter, coiled tubing thickness, linear beam length, hoisting load and internal pressure based on which the gripper controller 340 calculated the minimum gripper force, the maximum gripper force and determined the estimated gripping force. The previously applied one or more gripping forces extracted from the historical data model 342 may be representative of optimal values of the gripping force applied on previous occasions (e.g., to injector 10 or other injectors having similar properties) for the same or similar parameter values.

In one or more embodiments, the gripper controller 340 may be configured to determine an adjustment factor by comparing the estimated target gripping force and the one or more previously applied target gripping forces from the historical data model 342. The gripper controller 340 may be configured to apply the adjustment factor to the estimated gripping force to determine the target gripping force to apply to the gripper chains 126. The gripper controller 340 may determine the adjustment factor as a difference between the estimated gripping force and at least one previously applied target gripping force from the historical data model. This difference may be used to adjust the value of the estimated gripping force and determine the target gripping force to apply to the gripping chains 126. For example, when the determined estimated gripping force is 3000 newton and a previously applied target gripping force from the historical data model 342 is 3500 newton, the adjustment factor can be determined as 500, which can be added to the estimated gripping force to determine a target gripping force of 3500 newton. In one embodiment, when the historical data model provides several values of previously applied target gripping forces for the same set of parameter values, the grippier controller 340 may calculate an average of the previously applied values and determine the adjustment factor as a difference between the estimated gripping force and the average value of the previously applied target gripping forces. In one embodiment, the gripper controller 340 may be configured to limit the adjustment factor to a maximum value (e.g., a maximum amount of adjustment) to avoid large adjustments from being made at one time.

Once the target gripping force is determined, the gripper controller 340 may determine the target gripping pressure as a function of the determined target gripping force. The gripper controller may send an electronic signal to the gripper control circuit 350 (e.g., to electro-hydraulic valve 356) to adjust the gripping pressure of the gripper cylinders 185 and 188 to the determined target gripper pressure. For example, the gripper controller 340 may be configured to calculate the target gripper pressure according to equation (3) as shown below.

$$P_T = \frac{F_T}{A\eta} \tag{3}$$

wherein:

$P_T$—the target gripper pressure that is to be set for the gripper cylinders 185 and 188;

$F_T$—the target gripping force that is to be applied by the gripper chains onto the coiled tubing 18;

A—area of the gripper cylinders 185 and 188; and

η—efficiency of the gripper cylinders 185 and 188.

The gripper controller 340 may be configured to continuously monitor parameters related to the injector operation and fine tune the gripper pressure as needed (e.g., by determining target gripping forces and gripper pressures as described above) to ensure that an optimal force continues to be applied by the gripper chains 126 onto the coiled tubing 18 as values of one or more parameters change during the duration of the injector operation.

In one or more embodiments, the gripper controller 340 may be configured to add the determined target gripping force and the corresponding target gripper pressure to the historical data model 342 for subsequent use in determining gripping force and gripper pressure.

In one or more embodiments, the gripper controller 340 may be implemented by an artificial intelligence (AI) model. The AI model may be trained using historical data relating to the previously set gripper pressures and corresponding applied gripping forces from the historical data model 342. The trained AI model may be used to determine optimized gripping forces and gripper pressures in real world conditions. The gripper controller 340 may be configured to constantly update the AI model by adding newly set gripper pressures and corresponding applied gripping forces to the historical data model 342 and updating the training of the AI model based on the updated historical data model 342. As more real-time data relating to gripper pressures and gripping forces is added to the historical data model 342, the AI model may update itself thereby increasing the accuracy of determining optimized gripping force and gripper pressure values for a given set of parameter values.

Figure 5:
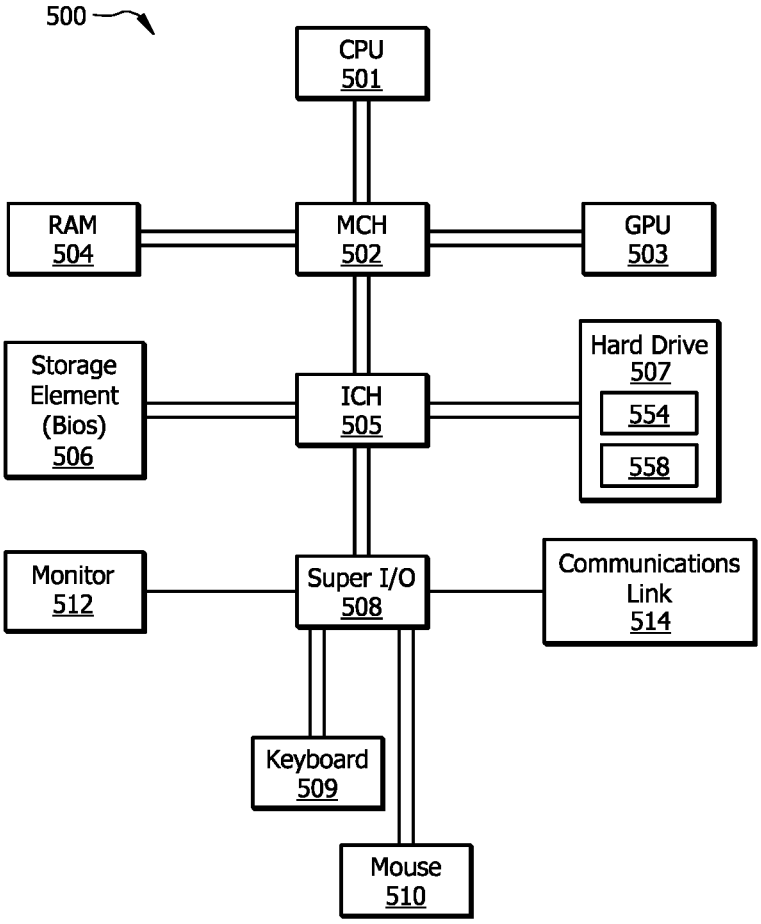
FIG. 5 is a diagram illustrating an example information handling system, in accordance with one or more embodiments of the present disclosure.

FIG. 5 is a diagram illustrating an example information handling system 500, for example, for use with coiled tubing injector system 100 of FIG. 1, injector 10 of FIG. 2 and/or system 300 shown in FIG. 3, in accordance with one or more embodiments of the present disclosure. The DAS 330 and/or the gripper controller 340 discussed above with reference to FIGS. 3 and 4 may take a form similar to the information handling system 500. A processor or central processing unit (CPU) 501 of the information handling system 500 is communicatively coupled to a memory controller hub (MCH) or north bridge 502. The processor 501 may include, for example a microprocessor, microcontroller, digital signal processor (DSP), application specific integrated circuit (ASIC), or any other digital or analog circuitry configured to interpret and/or execute program instructions and/or process data. Processor 501 may be configured to interpret and/or execute program instructions or other data retrieved and stored in any memory such as memory 504 or hard drive 507. Program instructions or other data may constitute portions of a software or application, for example application 558 or data 554, for carrying out one or more methods described herein. Memory 504 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application 558 or data 554 may be retrieved and stored in memory 504 for execution or use by processor 501. In one or more aspects, the memory 504 or the hard drive 507 may include or comprise one or more non-transitory executable instructions that, when executed by the processor 501 cause the processor 501 to perform or initiate one or more operations or steps. The information handling system 500 may be preprogrammed or it may be programmed (and reprogrammed) by loading a program from another source (for example, from a CD-ROM, from another computer device through a data network, or in another manner).

The data 554 may include treatment data, geological data, fracture data, seismic or micro seismic data, data relating to properties of the coiled tubing 18, data relating to properties of the injector 10, data relating to measured parameters during a coiled tubing injector operation or any other appropriate data. In one or more aspects, a memory of a computing device includes additional or different data, application, models, or other information. In one or more aspects, the data 554 may include geological data relating to one or more geological properties of the subterranean formation. For example, the geological data may include information on the wellbore, completions, or information on other attributes of the subterranean formation. In one or more aspects, the geological data includes information on the lithology, fluid content, stress profile (for example, stress anisotropy, maximum and minimum horizontal stresses), pressure profile, spatial extent, or other attributes of one or more rock formations in the subterranean zone. The geological data may include information collected from well logs, rock samples, outcroppings, seismic or microseismic imaging, or other data sources.

The one or more applications 558 may comprise one or more software applications, one or more scripts, one or more programs, one or more functions, one or more executables, or one or more other modules that are interpreted or executed by the processor 501. The one or more applications 558 may include one or more machine-readable instructions for performing one or more of the operations related to any one or more aspects of the present disclosure. The one or more applications 558 may include machine-readable instructions for determining optimized gripper pressures and gripping forces, as described with reference to FIGS. 1-4. The one or more applications 558 may obtain input data, such as data relating to properties of the coiled tubing 18, data relating to properties of the injector 10, data relating to measured parameters during a coiled tubing injector operation, seismic data, well data, treatment data, geological data, fracture data, or other types of input data, from the memory 504, from another local source, or from one or more remote sources (for example, via the one or more communication links 514). The one or more applications 558 may generate output data and store the output data in the memory 504, hard drive 507, in another local medium, or in one or more remote devices (for example, by sending the output data via the communication link 514).

Modifications, additions, or omissions may be made to FIG. 5 without departing from the scope of the present disclosure. For example, FIG. 5 shows a particular configuration of components of information handling system 500. However, any suitable configurations of components may be used. For example, components of information handling system 500 may be implemented either as physical or logical components. Furthermore, in one or more aspects, functionality associated with components of information handling system 500 may be implemented in special purpose circuits or components. In other aspects, functionality associated with components of information handling system 500 may be implemented in configurable general purpose circuit or components. For example, components of information handling system 500 may be implemented by configured computer program instructions.

Memory controller hub 502 may include a memory controller for directing information to or from various system memory components within the information handling system 500, such as memory 504, storage element 506, and hard drive 507. The memory controller hub 502 may be coupled to memory 504 and a graphics processing unit (GPU) 503. Memory controller hub 502 may also be coupled to an I/O controller hub (ICH) or south bridge 505. I/O controller hub 505 is coupled to storage elements of the information handling system 500, including a storage element 506, which may comprise a flash ROM that includes a basic input/output system (BIOS) of the computer system. I/O controller hub 505 is also coupled to the hard drive 507 of the information handling system 500. I/O controller hub 505 may also be coupled to an I/O chip or interface, for example, a Super I/O chip 508, which is itself coupled to several of the I/O ports of the computer system, including a keyboard 509, a mouse 510, a monitor 512 and one or more communications link 514. Any one or more input/output devices receive and transmit data in analog or digital form over one or more communication links 514 such as a serial link, a wireless link (for example, infrared, radio frequency, or others), a parallel link, or another type of link. The one or more communication links 514 may comprise any type of communication channel, connector, data communication network, or other link. For example, the one or more communication links 514 may comprise a wireless or a wired network, a Local Area Network (LAN), a Wide Area Network (WAN), a private network, a public network (such as the Internet), a wireless fidelity or WiFi network, a network that includes a satellite link, or another type of data communication network.

One or more embodiments of the present disclosure provide a system including a coiled tubing injector and an automatic gripper controller coupled to the coiled tubing injector. The coiled tubing injector includes at least two gripper chains, wherein each gripper chain has a plurality of gripper blocks for gripping a coiled tubing in a gripping zone between the gripper chains; and a gripper system for generating a gripping force applied to the at least two gripper chains, wherein the gripper system applies gripping force to the at least two gripper chains by adjusting gripper pressure of at least one hydraulic gripper cylinder. The gripper controller is configured to select a target gripper pressure between a minimum gripper pressure and a maximum gripper pressure; and set the target gripper pressure for the at least one gripper cylinder to apply a corresponding gripping force to the at least two gripper chains.

In one or more embodiments, the automatic gripper controller is configured to select the target gripper pressure based on a historical data model, wherein the historical data model includes, corresponding to a current set of parameters, one or more of a plurality of target gripping forces previously applied to the at least two gripper chains and a plurality of corresponding target gripper pressures previously set for the at least one gripper cylinder, wherein the current set of parameters is related to lowering the coiled tubing into a wellbore or pulling out the coiled tubing from the wellbore.

In one or more embodiments, the plurality of target gripper pressures of the historical data model comprises corresponding to the current set of parameters one or more target gripper pressures previously set for at least one second gripper cylinder of a second coiled tubing injector at a different wellbore In one or more embodiments, the plurality of target gripper pressures of the historical data model comprises corresponding to the current set of parameters one or more target gripper pressures previously set manually by an operator of the coiled tubing injector.

In one or more embodiments, the automatic gripper controller is further configured to determine the minimum gripper pressure to be set for the at least one gripper cylinder based on a current set of parameters related to lowering the coiled tubing into a wellbore or pulling out the coiled tubing from the wellbore; and determine the maximum gripper pressure that can be set for the at least one gripper cylinder based on the current set of parameters.

In one or more embodiments, the automatic gripper controller is configured to determine the maximum gripper pressure that can be set for the at least one gripper cylinder based on the current set of parameters by:

determining a maximum gripping force that can be applied to the at least two gripper chains based on the current set of parameters as:

$$F_y = \frac{-C_1(2C_2 - \sigma_x) + \sqrt{[(C_1(2C_2 - \sigma_x)]^2 - 4C_1^2(\sigma_x^2 + C_2^2 - \sigma_x C_2 - \sigma_{YS}^2)}}{2C_1^2}$$

wherein:

$F_y$—the maximum gripping force that can be applied to the at least two gripper chains; and the current set of parameters include:

$\sigma_x$—coiled tubing pipe axial stress caused by coiled tubing pipe hoisting load and internal pressure;

$\sigma_{ys}$—coiled Tubing yield strength;

$C_1$—a constant accounting for properties of the coiled tubing including one or more of coiled tubing outer diameter and a wall thickness of the coiled tubing; and $C_2$—a constant accounting for surface measurements of one or more parameters including one or more of hoisting load and internal pressure of the coiled tubing In one or more embodiments, the automatic gripper controller is configured to determine the maximum gripper pressure as:

$$P_y = \frac{F_y}{A\eta}$$

wherein:

$P_y$—the maximum gripper pressure that can be set for the at least one gripper cylinder; and the current set of parameters further includes:

A—area of the at least one gripper cylinder; and $\eta$—efficiency of the gripper cylinder.

In one or more embodiments, the automatic gripper controller is configured to select the target gripper pressure by: determining an estimated gripping force to be applied to the at least two gripper chains as a percentage of the determined maximum gripping force and above a minimum gripping force that is to be applied to the at least two gripper chains, wherein the minimum gripping force is a function of the determined minimum gripping pressure; determining a target gripping force that is to be applied to the at least two gripper chains by adjusting the estimated gripping force based on the plurality of previously applied target gripping forces corresponding to the current set of parameters; and determining the target gripper pressure as a function of the target gripping force.

In one or more embodiments, the percentage of the determined maximum gripping force is pre-configured.

In one or more embodiments, the automatic gripper controller is configured to determine the target gripping force by: determining an adjustment factor based on a difference between the estimated gripping force and at least one previously applied target gripping force from the historical data model; and applying the adjustment factor to the estimated gripping force to determine the target gripping force.

In one or more embodiments, the automatic gripper controller is further configured to add one or more of the determined target gripping force and target gripper pressure to the historical data model.

One or more embodiments of the present disclosure provide a method for operating a coiled tubing injector, comprising: automatically selecting a target gripper pressure between a minimum gripper pressure and a maximum gripper pressure, wherein a gripping force is applied to at least two gripper chains of the coiled tubing injector by adjusting gripper pressure of at least one gripper cylinder of the coiled tubing injector; and automatically setting the target gripper pressure for the at least one gripper cylinder to apply a corresponding gripping force to the at least two gripper chains.

In one or more embodiments, the target gripper pressure is selected based on a historical data model, wherein the historical data model includes, corresponding to a current set of parameters, one or more of a plurality of target gripping forces previously applied to the at least two gripper chains and a plurality of corresponding target gripper pressures previously set for the at least one gripper cylinder.

In one or more embodiments, the method further includes determining a minimum gripper pressure to be set for the at least one gripper cylinder based on a current set of parameters related to lowering a coiled tubing into a wellbore or pulling out the coiled tubing from the wellbore; and determining a maximum gripper pressure that can be set for the at least one gripper cylinder based on the current set of parameters.

In one or more embodiments, wherein determining the maximum gripper pressure that can be set for the at least one gripper cylinder based on the current set of parameters comprises: determining a maximum gripping force that can be applied to the at least two gripper chains based on the current set of parameters as:

$$F_y = \frac{-C_1(2C_2 - \sigma_x) + \sqrt{[(C_1(2C_2 - \sigma_x)]^2 - 4C_1^2(\sigma_x^2 + C_2^2 - \sigma_x C_2 - \sigma_{YS}^2)}}{2C_1^2}$$

wherein:

$F_y$—the maximum gripping force that can be applied to the at least two gripper chains; and the current set of parameters include:

$\sigma_x$—coiled tubing pipe axial stress caused by coiled tubing pipe hoisting load and internal pressure;

$\sigma_{ys}$—coiled Tubing yield strength;

$C_1$—a constant accounting for properties of the coiled tubing including one or more of coiled tubing outer diameter and a wall thickness of the coiled tubing; and $C_2$—a constant accounting for surface measurements of one or more parameters including one or more of hoisting load and internal pressure of the coiled tubing In one or more embodiments, wherein determining the maximum gripper pressure further comprises determining the maximum gripper pressure as:

$$P_y = \frac{F_y}{A\eta}$$

wherein:

$P_y$—the maximum gripper pressure that can be set for the at least one gripper cylinder; and the current set of parameters further includes:

A—area of the at least one gripper cylinder; and $\eta$—efficiency of the gripper cylinder.

In one or more embodiments, wherein selecting the target gripper pressure comprises: determining an estimated gripping force to be applied to the at least two gripper chains as a percentage of the determined maximum gripping force and above a minimum gripping force that is to be applied to the at least two gripper chains, wherein the minimum gripping force is a function of the determined minimum gripping pressure; determining a target gripping force that is to be applied to the at least two gripper chains by adjusting the estimated gripping force based on the plurality of previously applied target gripping forces corresponding to the current set of parameters; and determining the target gripper pressure as a function of the target gripping force.

In one or more embodiments, wherein the method further comprises pre-selecting the percentage of the determined maximum gripping force.

In one or more embodiments, wherein determining the target gripping force comprises: determining an adjustment factor based on a difference between the estimated gripping force and at least one previously applied target gripping force from the historical data model; applying the adjustment factor to the estimated gripping force to determine the target gripping force.

One or more embodiments of the present disclosure provides a computer-readable medium storing instructions which when processed by at least one processor perform a method for operating a coiled tubing injector comprising: automatically selecting a target gripper pressure between a minimum gripper pressure and a maximum gripper pressure, wherein a gripping force is applied to at least two gripper chains of the coiled tubing injector by adjusting gripper pressure of at least one gripper cylinder of the coiled tubing injector; and automatically setting the target gripper pressure for the at least one gripper cylinder to apply a corresponding gripping force to the at least two gripper chains.

In one or more embodiments, the target gripper pressure is selected based on a historical data model, wherein the historical data model includes, corresponding to a current set of parameters, one or more of a plurality of target gripping forces previously applied to the at least two gripper chains and a plurality of corresponding target gripper pressures previously set for the at least one gripper cylinder.

In one or more embodiments, the computer-readable medium further includes instructions for determining a minimum gripper pressure to be set for the at least one gripper cylinder based on a current set of parameters related to lowering a coiled tubing into a wellbore or pulling out the coiled tubing from the wellbore; and determining a maximum gripper pressure that can be set for the at least one gripper cylinder based on the current set of parameters.

In one or more embodiments, determining the maximum gripper pressure that can be set for the at least one gripper cylinder based on the current set of parameters comprises: determining a maximum gripping force that can be applied to the at least two gripper chains based on the current set of parameters as:

$$F_y = \frac{-C_1(2C_2 - \sigma_x) + \sqrt{[(C_1(2C_2 - \sigma_x)]^2 - 4C_1^2(\sigma_x^2 + C_2^2 - \sigma_x C_2 - \sigma_{YS}^2)}}{2C_1^2}$$

wherein:

$F_y$—the maximum gripping force that can be applied to the at least two gripper chains; and the current set of parameters include:

$\sigma_x$—coiled tubing pipe axial stress caused by coiled tubing pipe hoisting load and internal pressure;

$\sigma_{ys}$—coiled Tubing yield strength;

$C_1$—a constant accounting for properties of the coiled tubing including one or more of coiled tubing outer diameter and a wall thickness of the coiled tubing; and $C_2$—a constant accounting for surface measurements of one or more parameters including one or more of hoisting load and internal pressure of the coiled tubing.

In one or more embodiments, determining the maximum gripper pressure further comprises determining the maximum gripper pressure as:

$$P_y = \frac{F_y}{A\eta}$$

wherein:

$P_y$—the maximum gripper pressure that can be set for the at least one gripper cylinder; and the current set of parameters further includes:

A—area of the at least one gripper cylinder; and $\eta$—efficiency of the gripper cylinder.

In one or more embodiments, selecting the target gripper pressure comprises: determining an estimated gripping force to be applied to the at least two gripper chains as a percentage of the determined maximum gripping force and above a minimum gripping force that is to be applied to the at least two gripper chains, wherein the minimum gripping force is a function of the determined minimum gripping pressure; determining a target gripping force that is to be applied to the at least two gripper chains by adjusting the estimated gripping force based on the plurality of previously applied target gripping forces corresponding to the current set of parameters; and determining the target gripper pressure as a function of the target gripping force.

In one or more embodiments, determining the target gripping force comprises: determining an adjustment factor based on a difference between the estimated gripping force and at least one previously applied target gripping force from the historical data model; applying the adjustment factor to the estimated gripping force to determine the target gripping force.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the elements that it introduces.

What is claimed is:

1. A system comprising:

a coiled tubing injector comprising:

at least two gripper chains, wherein each gripper chain has a plurality of gripper blocks for gripping a coiled tubing in a gripping zone between the gripper chains;

a gripper system for generating a gripping force applied to the at least two gripper chains, wherein the gripper system applies the gripping force to the at least two gripper chains by adjusting a gripper pressure of at least one hydraulic gripper cylinder; and an automatic gripper controller, wherein the automatic gripper controller is configured to:

automatically determine an operating pressure window comprising a minimum gripper pressure to avoid pipe slippage and a maximum gripper pressure to avoid pipe damage; and adjust a target gripper pressure for the at least one gripper cylinder as needed to within the operating pressure window to apply the corresponding gripping force to the at least two gripper chains.

2. The system of claim 1, wherein the automatic gripper controller is configured to select the target gripper pressure based on a historical data model, wherein the historical data model includes, corresponding to a current set of parameters, one or more of a plurality of target gripping forces previously applied to the at least two gripper chains and a plurality of corresponding target gripper pressures previously set for the at least one gripper cylinder, wherein the current set of parameters is related to lowering the coiled tubing into a wellbore or pulling out the coiled tubing from the wellbore.

3. The system of claim 2, wherein the plurality of target gripper pressures of the historical data model comprises corresponding to the current set of parameters one or more target gripper pressures previously set for at least one second gripper cylinder of a second coiled tubing injector at a different wellbore.

4. The system of claim 2, wherein the plurality of target gripper pressures of the historical data model comprises corresponding to the current set of parameters one or more target gripper pressures previously set manually by an operator of the coiled tubing injector.

5. The system of claim 1, wherein the automatic gripper controller is further configured to:

determine the minimum gripper pressure to be set for the at least one gripper cylinder based on a current set of parameters related to lowering the coiled tubing into a wellbore or pulling out the coiled tubing from the wellbore; and determine the maximum gripper pressure that can be set for the at least one gripper cylinder based on the current set of parameters.

6. The system of claim 1, wherein the automatic gripper controller is configured to determine the maximum gripper pressure that can be set for the at least one gripper cylinder based on the current set of parameters by:

determining a maximum gripping force that can be applied to the at least two gripper chains based on the current set of parameters as:

$$F_y = \frac{-C_1(2C_2 - \sigma_x) + \sqrt{[(C_1(2C_2 - \sigma_x)]^2 - 4C_1^2(\sigma_x^2 + C_2^2 - \sigma_x C_2 - \sigma_{YS}^2)}}{2C_1^2}$$

wherein:

$F_y$—the maximum gripping force that can be applied to the at least two gripper chains; and the current set of parameters include:

$\sigma_x$—coiled tubing pipe axial stress caused by coiled tubing pipe hoisting load and internal pressure;

$\sigma_{ys}$—coiled Tubing yield strength;

$C_1$—a constant accounting for properties of the coiled tubing including one or more of coiled tubing outer diameter and a wall thickness of the coiled tubing; and $C_2$—a constant accounting for surface measurements of one or more parameters including one or more of hoisting load and internal pressure of the coiled tubing.

7. The system of claim 6, wherein the automatic gripper controller is configured to determine the maximum gripper pressure as:

$$P_y = \frac{F_y}{A\eta}$$

wherein:

$P_y$—the maximum gripper pressure that can be set for the at least one gripper cylinder; and the current set of parameters further includes:

A—area of the at least one gripper cylinder; and $\eta$—efficiency of the gripper cylinder.

8. The system of claim 1, wherein the automatic gripper controller is configured to select the target gripper pressure by:

determining an estimated gripping force to be applied to the at least two gripper chains as a percentage of the determined maximum gripping force and above a minimum gripping force that is to be applied to the at least two gripper chains, wherein the minimum gripping force is a function of the determined minimum gripping pressure;

determining a target gripping force that is to be applied to the at least two gripper chains by adjusting the estimated gripping force based on the plurality of previously applied target gripping forces corresponding to the current set of parameters; and determining the target gripper pressure as a function of the target gripping force.

9. The system of claim 8, wherein the percentage of the determined maximum gripping force is pre-configured.

10. The system of claim 8, wherein the automatic gripper controller is configured to determine the target gripping force by:

determining an adjustment factor based on a difference between the estimated gripping force and at least one previously applied target gripping force from the historical data model; and applying the adjustment factor to the estimated gripping force to determine the target gripping force.

11. The system of claim 8, wherein the automatic gripper controller is further configured to add one or more of the determined target gripping force and target gripper pressure to the historical data model.

12. A method for operating a coiled tubing injector, comprising:

automatically determining an operating pressure window comprising a minimum gripper pressure to avoid pipe slippage and a maximum gripper pressure to avoid pipe damage, wherein a gripping force is applied to at least two gripper chains of the coiled tubing injector by adjusting a gripper pressure of at least one gripper cylinder of the coiled tubing injector;

continuously monitoring one or more parameters relating to an injector operation; and automatically adjusting a target gripper pressure for the at least one gripper cylinder to maintain the target gripper pressure within the operating pressure window; and applying the corresponding gripping force to the at least two gripper chains.

13. The method of claim 12, wherein the target gripper pressure is selected based on a historical data model, wherein the historical data model includes, corresponding to a current set of parameters, one or more of a plurality of target gripping forces previously applied to the at least two gripper chains and a plurality of corresponding target gripper pressures previously set for the at least one gripper cylinder.

14. The method of claim 12, further comprising:

determining the minimum gripper pressure to be set for the at least one gripper cylinder based on a current set of parameters related to lowering a coiled tubing into a wellbore or pulling out the coiled tubing from the wellbore; and determining the maximum gripper pressure that can be set for the at least one gripper cylinder based on the current set of parameters.

15. The method of claim 12, wherein determining the maximum gripper pressure that can be set for the at least one gripper cylinder based on the current set of parameters comprises:

determining a maximum gripping force that can be applied to the at least two gripper chains based on the current set of parameters as:

$$F_y = \frac{-C_1(2C_2 - \sigma_x) + \sqrt{[(C_1(2C_2 - \sigma_x)]^2 - 4C_1^2(\sigma_x^2 + C_2^2 - \sigma_x C_2 - \sigma_{YS}^2)}}{2C_1^2}$$

wherein:

$F_y$—the maximum gripping force that can be applied to the at least two gripper chains; and the current set of parameters include:

$\sigma_x$—coiled tubing pipe axial stress caused by coiled tubing pipe hoisting load and internal pressure;

$\sigma_{ys}$—coiled Tubing yield strength;

$C_1$—a constant accounting for properties of the coiled tubing including one or more of coiled tubing outer diameter and a wall thickness of the coiled tubing; and $C_2$—a constant accounting for surface measurements of one or more parameters including one or more of hoisting load and internal pressure of the coiled tubing.

16. The method of claim 15, wherein determining the maximum gripper pressure further comprises determining the maximum gripper pressure as:

$$P_y = \frac{F_y}{A\eta}$$

wherein:

$P_y$—the maximum gripper pressure that can be set for the at least one gripper cylinder; and the current set of parameters further includes:

A—area of the at least one gripper cylinder; and $\eta$—efficiency of the gripper cylinder.

17. The method of claim 12, wherein selecting the target gripper pressure comprises:

determining an estimated gripping force to be applied to the at least two gripper chains as a percentage of the determined maximum gripping force and above a minimum gripping force that is to be applied to the at least two gripper chains, wherein the minimum gripping force is a function of the determined minimum gripping pressure;

determining a target gripping force that is to be applied to the at least two gripper chains by adjusting the estimated gripping force based on the plurality of previously applied target gripping forces corresponding to the current set of parameters; and determining the target gripper pressure as a function of the target gripping force.

18. The method of claim 17, further comprising preselecting the percentage of the determined maximum gripping force.

19. The method of claim 17, wherein determining the target gripping force comprises:

determining an adjustment factor based on a difference between the estimated gripping force and at least one previously applied target gripping force from the historical data model; and applying the adjustment factor to the estimated gripping force to determine the target gripping force.

20. A computer-readable medium storing instructions which when processed by at least one processor perform a method for operating a coiled tubing injector comprising:

automatically determining an operating pressure window comprising a minimum gripper pressure to avoid pipe slippage and a maximum gripper pressure to avoid pipe damage, wherein a gripping force is applied to at least two gripper chains of the coiled tubing injector by adjusting gripper pressure of at least one gripper cylinder of the coiled tubing injector; and automatically adjusting a target gripper pressure as needed to within the operating pressure window for the at least one gripper cylinder to apply a corresponding gripping force to the at least two gripper chains.

21. The computer-readable medium of claim 20, wherein the target gripper pressure is selected based on a historical data model, wherein the historical data model includes, corresponding to a current set of parameters, one or more of a plurality of target gripping forces previously applied to the at least two gripper chains and a plurality of corresponding target gripper pressures previously set for the at least one gripper cylinder.

22. The computer-readable medium of claim 20, further comprising instructions for:

determining the minimum gripper pressure to be set for the at least one gripper cylinder based on a current set of parameters related to lowering a coiled tubing into a wellbore or pulling out the coiled tubing from the wellbore; and determining the maximum gripper pressure that can be set for the at least one gripper cylinder based on the current set of parameters.

23. The computer-readable medium of claim 20, wherein determining the maximum gripper pressure that can be set for the at least one gripper cylinder based on the current set of parameters comprises:

determining a maximum gripping force that can be applied to the at least two gripper chains based on the current set of parameters as:

$$F_y = \frac{-C_1(2C_2 - \sigma_x) + \sqrt{[(C_1(2C_2 - \sigma_x)]^2 - 4C_1^2(\sigma_x^2 + C_2^2 - \sigma_x C_2 - \sigma_{YS}^2)}}{2C_1^2}$$

wherein:

$F_y$—the maximum gripping force that can be applied to the at least two gripper chains; and the current set of parameters include:

$\sigma_x$—coiled tubing pipe axial stress caused by coiled tubing pipe hoisting load and internal pressure;

$\sigma_{ys}$—coiled Tubing yield strength;

$C_1$—a constant accounting for properties of the coiled tubing including one or more of coiled tubing outer diameter and a wall thickness of the coiled tubing; and $C_2$—a constant accounting for surface measurements of one or more parameters including one or more of hoisting load and internal pressure of the coiled tubing.

24. The computer-readable medium of claim 23, wherein determining the maximum gripper pressure further comprises determining the maximum gripper pressure as:

$$P_y = \frac{F_y}{A\eta}$$

wherein:

$P_y$—the maximum gripper pressure that can be set for the at least one gripper cylinder; and the current set of parameters further includes:

A—area of the at least one gripper cylinder; and $\eta$—efficiency of the gripper cylinder.

25. The computer-readable medium of claim 20, wherein selecting the target gripper pressure comprises:

determining an estimated gripping force to be applied to the at least two gripper chains as a percentage of the determined maximum gripping force and above a minimum gripping force that is to be applied to the at least two gripper chains, wherein the minimum gripping force is a function of the determined minimum gripping pressure;

determining a target gripping force that is to be applied to the at least two gripper chains by adjusting the estimated gripping force based on the plurality of previously applied target gripping forces corresponding to the current set of parameters; and determining the target gripper pressure as a function of the target gripping force.

26. The computer-readable medium of claim 25, wherein determining the target gripping force comprises:

determining an adjustment factor based on a difference between the estimated gripping force and at least one previously applied target gripping force from the historical data model;

applying the adjustment factor to the estimated gripping force to determine the target gripping force.

* * * * *